US006155901A

United States Patent [19]

Chen

[11] Patent Number: 6,155,901

[45] Date of Patent: Dec. 5, 2000

[54] LIGHT-EMITTING INFLATABLE ENVELOPE STRUCTURE

[76] Inventor: David Chen, No. 140, Hsin-Ma Rd., Suao Town, Ilan County, Taiwan

[21] Appl. No.: 09/245,900

[22] Filed: Feb. 8, 1999

[51] Int. Cl.[7] ..... A63H 27/10

[52] U.S. Cl. ..... 446/224; 446/485

[58] Field of Search ..... 446/220, 224, 446/485; 137/844, 846, 223; 40/214, 212, 736

[56] References Cited

U.S. PATENT DOCUMENTS

| | | | |
|---|---|---|---|
| 4,708,167 | 11/1987 | Koyanagi | 137/512.15 |
| 4,850,912 | 7/1989 | Koyanagi | 441/40 |
| 4,917,646 | 4/1990 | Kieves | 446/224 |
| 4,997,403 | 3/1991 | Akman | 446/220 |
| 5,209,264 | 5/1993 | Koyanagi | 137/852 |
| 5,595,521 | 1/1997 | Becker | 446/224 |
| 5,807,157 | 9/1998 | Penjuke | 446/220 |

*Primary Examiner*—Jacob K. Ackun
*Attorney, Agent, or Firm*—Dougherty & Troxell

[57] ABSTRACT

A light-emitting inflatable envelope structure equipped with a nozzle composed of at least two overlapped membranes. The lateral edges of the membranes are fused with or adhered to each other to define an air passage communicating an inner side of the envelope with an outer side. The air passage is formed with at least one receptacle for receiving a light emitting body. After the envelope is inflated through the nozzle, the air pressure in the envelope inwardly compresses the membranes of the air passage to achieve an air-tight state of the air passage. The light emitting body in the receptacle is directly enclosed by the two membranes of the air passage and firmly associated with the envelope without using any other clamping or connecting member.

7 Claims, 6 Drawing Sheets

LIGHT-EMITTING INFLATABLE ENVELOPE STRUCTURE

BACKGROUND OF THE INVENTION

The present invention relates to a light-emitting inflatable envelope structure equipped with a nozzle having an air passage communicating an inner side of the envelope with an outer side thereof. The air passage is formed with a receptacle for receiving therein a light emitting body. After the envelope is inflated, the air pressure in the envelope makes the air passage self-close so as to easily associate the light emitting body with the inflatable envelope to achieve a visually entertaining effect.

Various types of lanterns are commercially available nowadays, such as animal or cartoon patterned lanterns. However, the conventional lanterns are varied only in pattern, while lacking novel modification in structure. A light source is placed in the lantern and associated therewith by a string or other clamping member. This procedure is troublesome and thus the manufacturing efficiency of the lantern can be hardly promoted.

Moreover, the light source in the conventional lantern is in a half-open state and is apt to be damaged due to collision of an alien article or by humidity.

SUMMARY OF THE INVENTION

It is a primary object of the present invention to provide a light-emitting inflatable envelope structure equipped with a membrane-type nozzle having an air passage communicating an inner side of the envelope with an outer side thereof. The air passage in the envelope is formed with a receptacle for receiving therein a light emitting body. After the envelope is inflated through the nozzle, the air pressure in the envelope inwardly compresses the membranes of the air passage to make the nozzle self-close. Therefore, the light emitting body can be naturally firmly enclosed by the membranes of the air passage and easily associated with the inflatable envelope without using any other connecting member. The envelope with the light emitting body is able to achieve a visually entertaining effect as a lantern and simplify the structure of the conventional lantern.

It is a further object of the present invention to provide the above light-emitting inflatable envelope in which the light emitting body is enclosed by the membranes of the air, passage and protected from colliding with by alien articles. Moreover, the light emitting body is isolated from humidity so that the useful life is prolonged.

The present invention can be best understood through the following description and accompanying drawings, wherein:

DETAILED DESCRIPTION OF THE PREFERRED EMBODIMENTS

Figure 1:
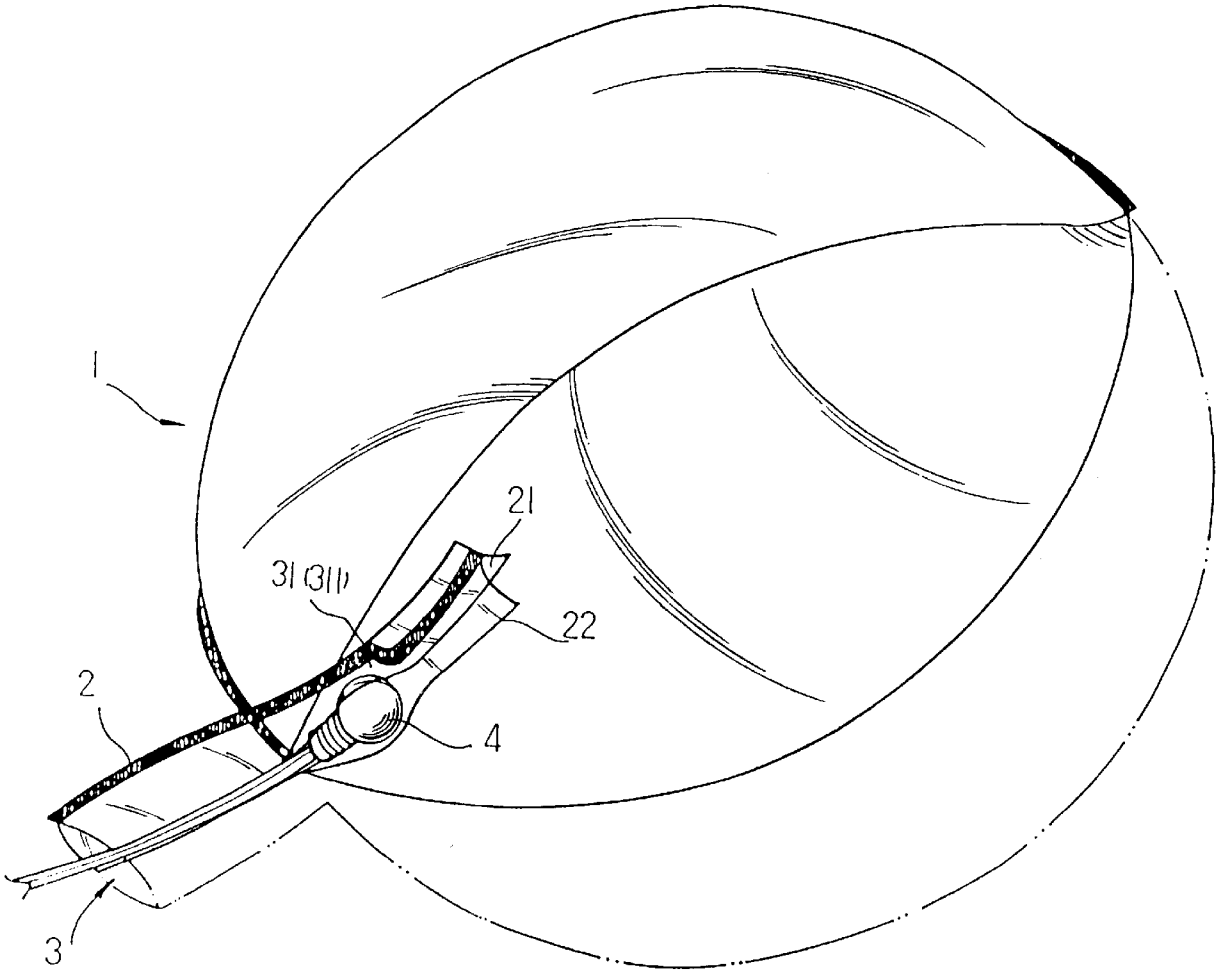
FIG. 1 is a perspective sectional view of the present invention.
Figure 3:
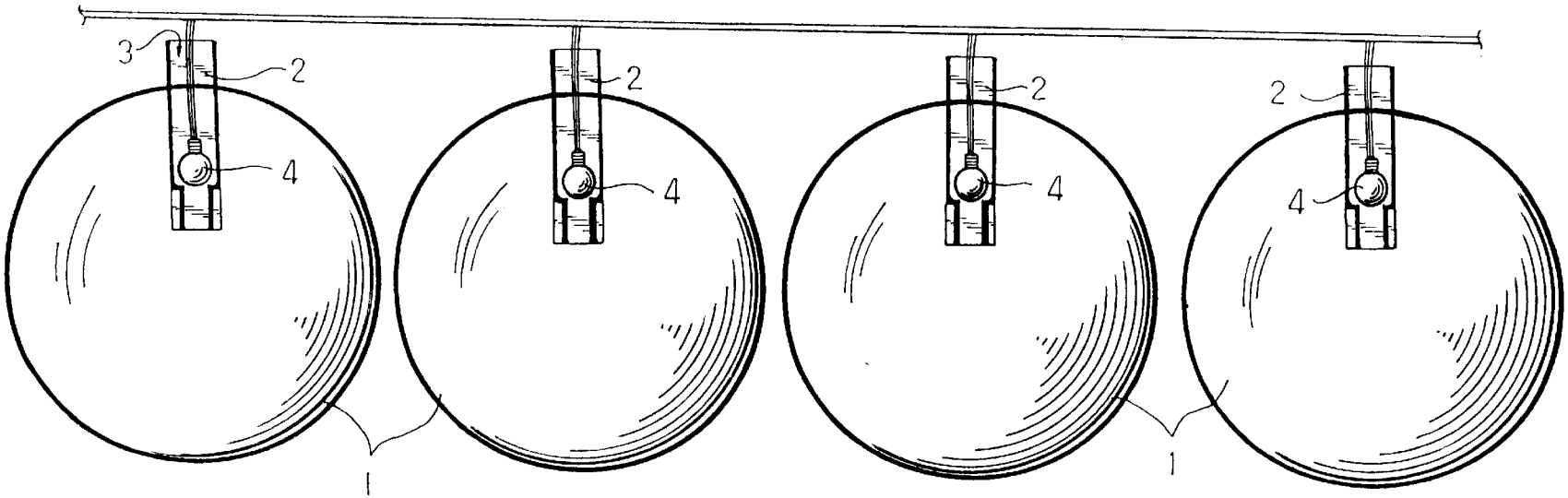
FIGS. 3 and 3A show modification of the present invention.

Please refer to FIG. 1. The nozzle 2 of the present invention is composed of two overlapped membranes 21, 22 extending from an outer side to an inner side of an envelope 1. The lateral edges of the membranes 21, 22 are fused with or adhered to each other to define an air passage 3 communicating the inner side of the envelope 1 with the outer side thereof. An inner portion of the air passage 3 inside the envelope 1 is formed with a receptacle 31 (defined by a neck section 311) for receiving therein a light emitting body 4. After the envelope 1 is inflated through the air passage 3, the air pressure in the envelope 1 inwardly compresses the membranes 21, 22 of the air passage 3 to achieve an air-tight state of the air passage 3. Therefore, the envelope 1 can be self-sealed and the light emitting body 4 in the receptacle 31 is enclosed by the two membranes 21, 22 and firmly associated with the envelope 1 without using any string or other clamping members. Referring to FIG. 3, according to a preferred embodiment of the present invention, multiple light emitting envelopes 1 can be serially connected with each other by a rope or an elongated member to form a hanging lamp for achieving a visually entertaining effect. By means of the above arrangement, the light emitting body 4 can be easily associated with the envelope to eliminate the inconvenience and trouble existing in the conventional lantern processing procedure and widen the range of use of the inflatable envelope.

Figure 1A:
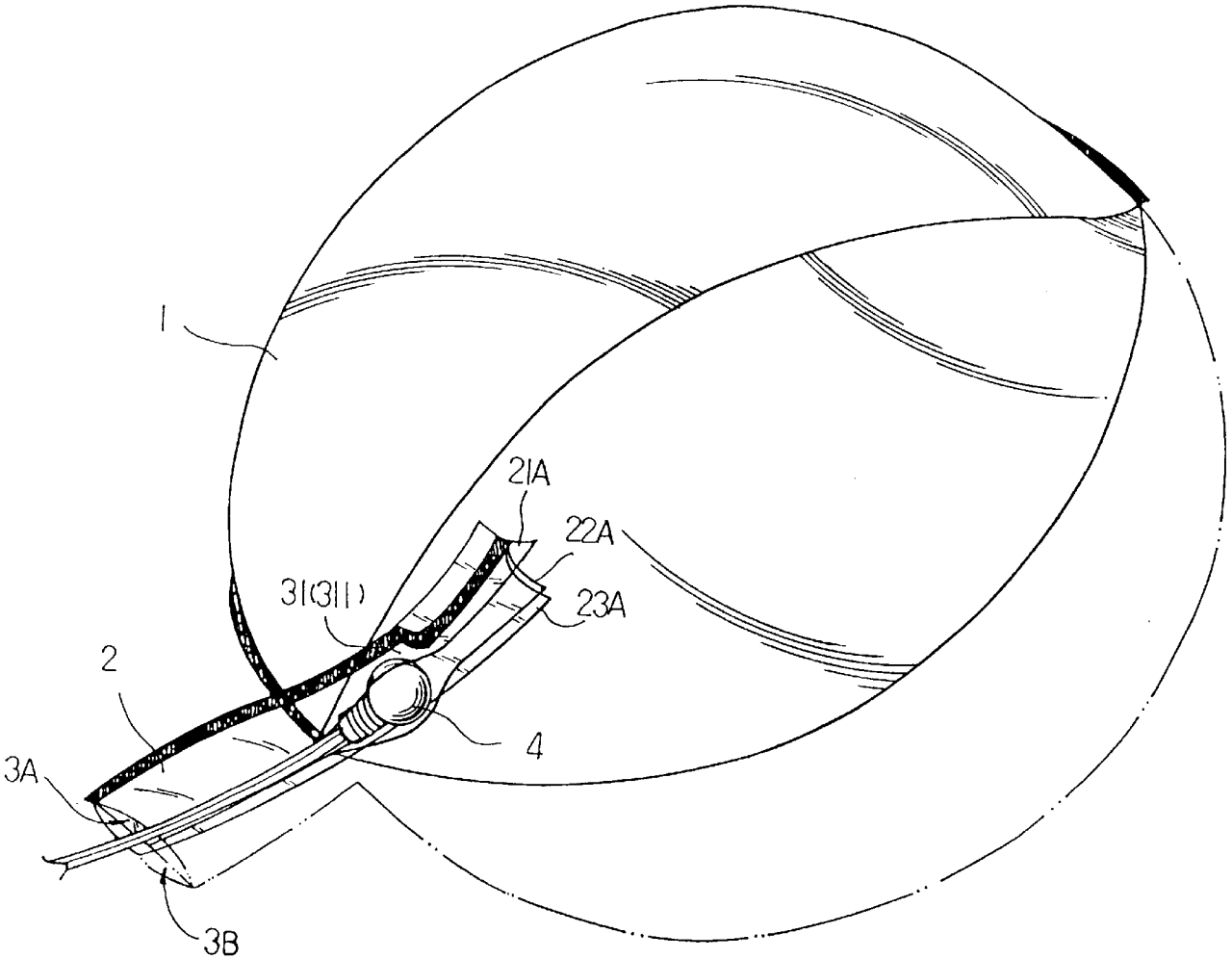
FIG. 1A is a perspective sectional view of another embodiment of the present invention.
Figure 2:
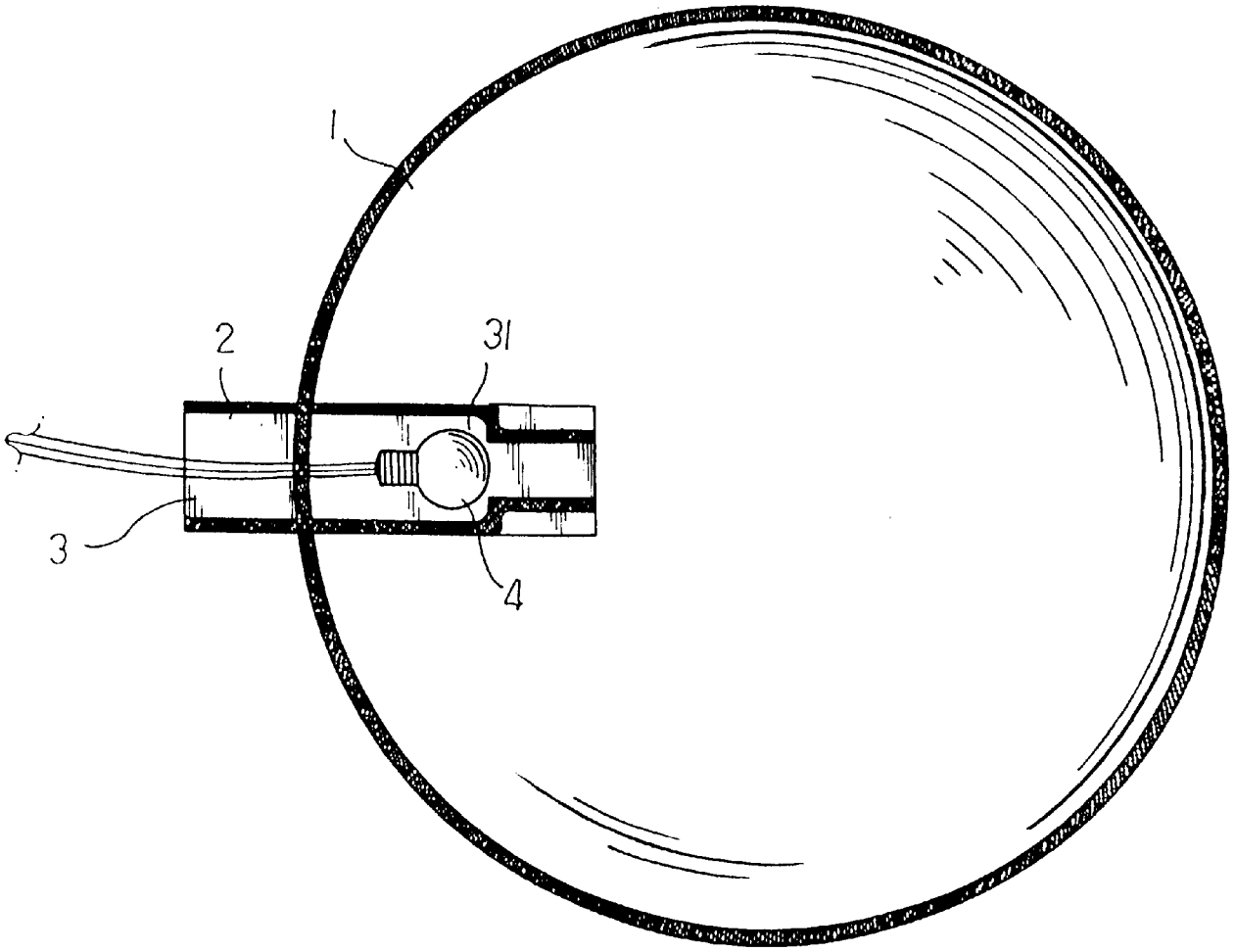
FIG. 2 is a plane sectional view of the present invention.

Referring to FIG. 1A, the nozzle 2 of the present invention can be also formed by at least three layers of membranes 21A, 22A, 23A to define a passage 3A, 3B between each two adjacent layers. A light emitting body 4 can be placed in one of the passages, while the other passage is used for inflating the envelope. Therefore, the inflation air passage is distinguished from the other so as to enhance the air-sealing effect. Certainly, the inner end of the passage for receiving the light emitting body 4 can be closed.

Figure 4A:
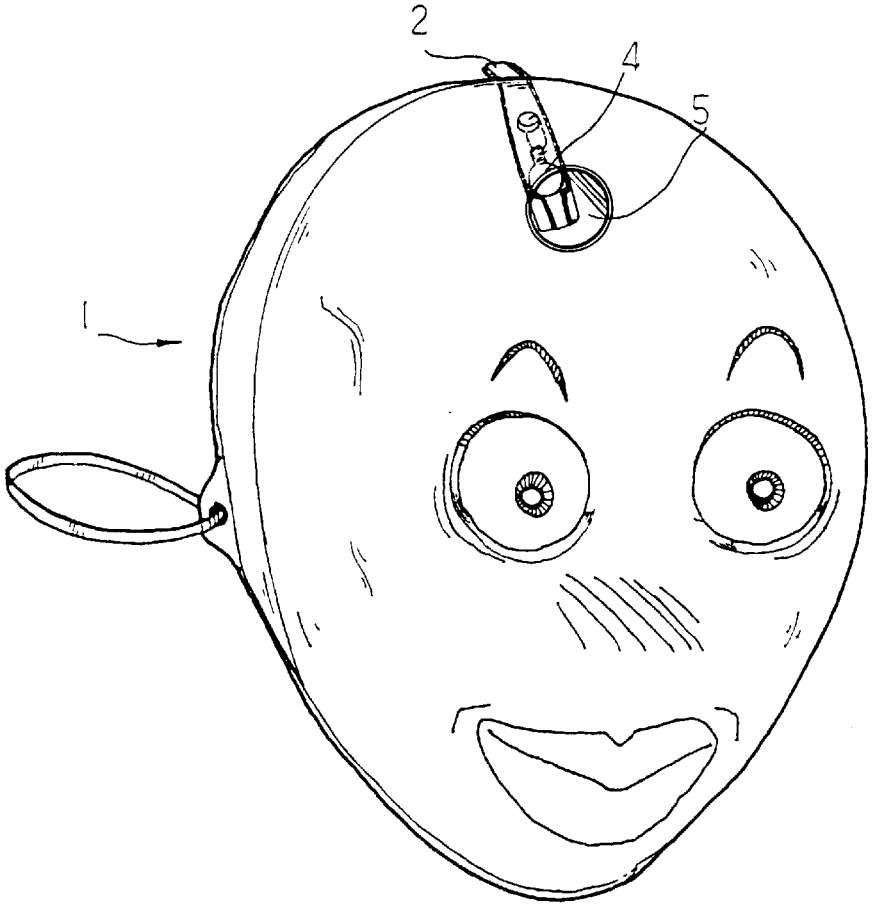
FIG. 4A shows the present invention with a mask pattern.
Figure 4B:
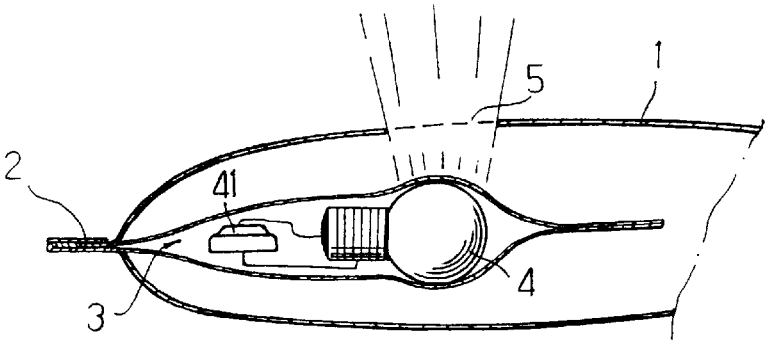
FIG. 4B is a sectional view according to FIG. 4A.

FIGS. 4A and 4B which show still another embodiment of the present invention. The envelope 1 and the nozzle 2 are identical to the above and will not be further described. This embodiment is characterized in that the envelope 1 is formed with a mask pattern. A light emitting body 4 and a power supply 41 are received in the receptacle 31 of the nozzle 2. At least one of the membranes 21 (or 22) in the air passage 31 is disposed with an adhesive material (not shown) on which a release sheet (not shown) is attached. One end of the release sheet is attached to the inner membrane wall of the nozzle 2 with the adhesive material, while the other end of the release sheet extends to outer side of the air passage 3. After the envelope 1 is inflated to a certain extent, the air pressure in the envelope 1 compresses the membranes 21, 22 of the air passage 3 to make the nozzle self-close. In addition, the release sheet can be torn away so that the adhesive material can adhere the corresponding inner membrane walls of the nozzle 2 to each other so as to enhance the air-sealing effect for the envelope 1. By means of the self-closing effect, the light emitting body 1 and the power supply 41 in the receptacle 31 are tightly enclosed by the membranes 21, 22 and associated with the envelope 1. A portion of the mask corresponding to the light emitting body 4 is formed with a transparent section 5, whereby the light can be projected through the transparent section to achieve an entertaining effect.

Figure 3A:
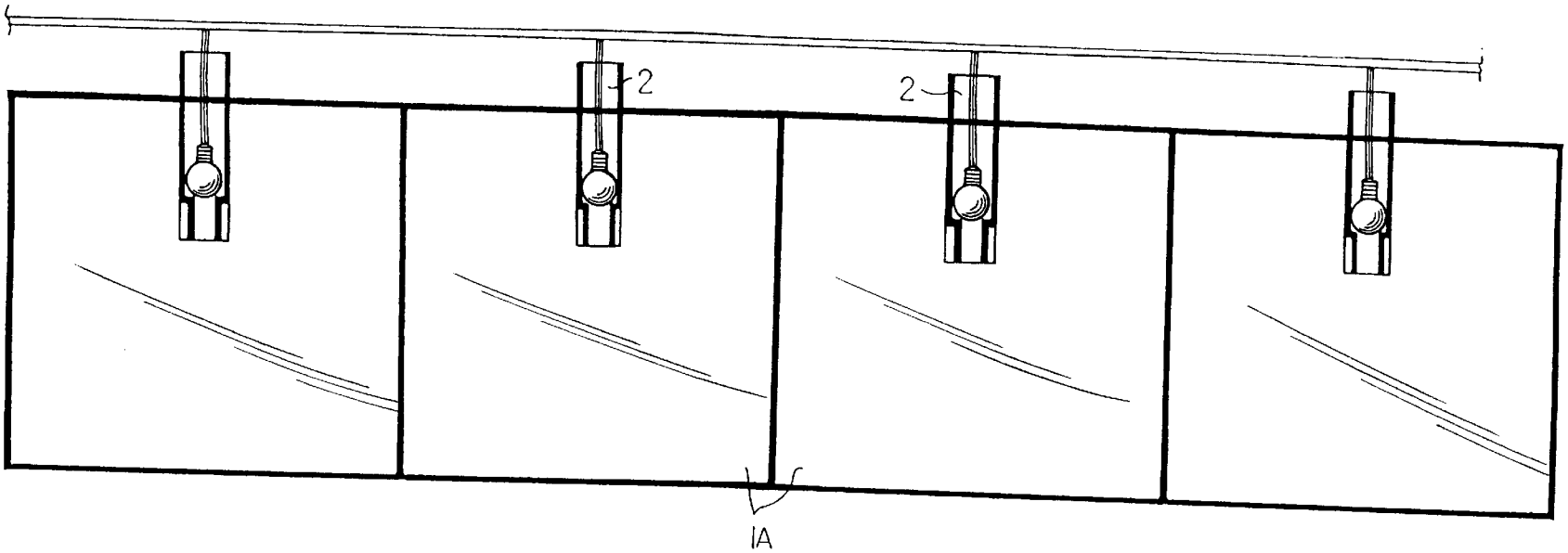

Referring to FIG. 3A, the envelope 1 of the present invention can be formed by multiple envelopes 1A which are integrally connected with each other. Multiple light emitting envelopes 1 can be further serially connected by a string or an elongated member to form a hanging lantern so as to achieve a visual entertaining effect.

It should be noted that the above description and accompanying drawings are only used to illustrate some embodiments of the present invention, not intended to limit the scope thereof. Any modification of the embodiments should fall within the scope of the present invention.

What is claimed is:

1. A light emitting inflatable device comprising:

a) at least one envelope bounding an inner space;

b) a nozzle having an inner portion extending into the inner space and an outer portion extending outwardly of the at least one envelope, the nozzle comprising at least two overlapped membranes having lateral edges affixed to each other thereby forming an air passage communicating the inner space with space outside of the envelope, whereby air pressure within the envelope greater than ambient air pressure inflates the envelope and urges at least two of the overlapped membranes of the inner section against each other to seal the air passage;

c) a receptacle section formed in the inner portion of the nozzle inside the at least one envelope; and, d) a light emitting body located in the receptacle section inside the envelope between the at least two overlapped membranes, the light emitting body retained in the receptacle section solely by the overlapped membranes being urged against each other.

2. The light emitting inflatable device of claim 1 wherein the nozzle comprises three overlapping membranes with lateral edges affixed to each other, the nozzle forming first and second passages whereby the light emitting body is located in one of the first and second passages.

3. The light emitting inflatable device of claim 1 comprising a plurality of envelopes, each envelope having:

a) a nozzle having an inner portion extending into the inner space and an outer portion extending outwardly of the at least one envelope, the nozzle comprising at least two overlapped membranes having lateral edges affixed to each other thereby forming an air passage communicating the inner space with space outside of the envelope, whereby air pressure within the envelope greater than ambient air pressure inflates the envelope and urges at least two of the overlapped membranes of the inner section against each other to seal the air passage;

b) a receptacle section formed in the inner portion of the nozzle inside the at least one envelope; and, c) a light emitting body located in the receptacle section inside the envelope between the at least two overlapped membranes, the light emitting body retained in the receptacle section solely by the overlapped membranes being urged against each other.

4. The light emitting inflatable device of claim 3 wherein the plurality of envelopes are located adjacent to each other and each two adjacent envelopes are separated by a common envelope wall.

5. The light emitting inflatable device of claim 1 further comprising an electrical power supply located in the receptacle section and connected to the light emitting body.

6. The light emitting inflatable device of claim 1 wherein the envelope has at least one transparent section.

7. The light emitting inflatable device of claim 6 wherein the envelope has a plurality of transparent sections.

* * * * *